US007273048B1

(12) United States Patent
Zuzelo

(10) Patent No.: US 7,273,048 B1
(45) Date of Patent: Sep. 25, 2007

(54) APPARATUS FOR CLEANING CRACKS IN A PAVED SURFACE IN PREPARATION OF SURFACE REPAIR

(76) Inventor: Edward A. Zuzelo, P.O. Box 450, Conshohocken, PA (US) 19428

( * ) Notice: Subject to any disclaimer, the term of this patent is extended or adjusted under 35 U.S.C. 154(b) by 0 days.

(21) Appl. No.: 11/217,420

(22) Filed: Sep. 2, 2005

(51) Int. Cl.
*B28D 1/04* (2006.01)

(52) U.S. Cl. ..... 125/13.01

(58) Field of Classification Search ..... 125/13.01, 125/13.03, 15, 22
See application file for complete search history.

(56) References Cited

U.S. PATENT DOCUMENTS 5,724,956 A * 3/1998 Ketterhagen ..... 125/13.01
6,102,022 A * 8/2000 Schave ..... 125/13.01
6,874,493 B2 * 4/2005 Glenn ..... 125/12

* cited by examiner

*Primary Examiner*—Jacob K. Ackun, Jr.
(74) *Attorney, Agent, or Firm*—LaMorte & Associates

(57) ABSTRACT

A cutting machine for cutting material from a crack that is present in a paved surface. The cutting machine has a circular cutting blade. The cutting blade has an axis of rotation and a mid-axis that is perpendicular to the axis of rotation. A wheeled platform is provided having wheels that are configured and oriented to cause the wheeled platform to turn about a predetermined point when the wheeled platform turns. A mounting arbor is supported under the wheeled platform. The mounting arbor retains the circular cutting blade in a position where its mid-axis generally aligns with the predetermined point around which the wheeled platform turns. The mid-axis of the cutting blade therefore remains in a fixed position when the wheeled platform is turned in a new direction. This allows the cutting blade to remain within the paved surface.

12 Claims, 3 Drawing Sheets

APPARATUS FOR CLEANING CRACKS IN A PAVED SURFACE IN PREPARATION OF SURFACE REPAIR

BACKGROUND OF THE INVENTION

1. Field of the Invention

In general, the present invention relates to portable cutting machines that are used to cut grooves in paved surfaces. More particularly, the present invention relates to cutting machines that are used to cut away loose material from in and around cracks that may be present in the paved surface.

2. Prior Art Description

Many surfaces, such as streets, parking lots, driveways and the like are paved either in asphalt or concrete. Over time, cracks have a tendency to develop in the pavement material. As cracks develop, water is able to seep deeper and deeper into the pavement material. As the water, repeatedly freezes and thaws, the water expands the crack. This increases the size of the cracks, thereby letting even more water and dirt into the cracks. Once dirt is present in a crack, seeds can take root in the cracks. The roots of growing plants further increase the size and number of cracks, thereby letting more and more water, dirt and seeds into the pavement. Eventually, the prevalence and severity of the cracks become so pronounced that the integrity of the paved surface is compromised. Once so damaged, the paved surface cannot be economically repaired. The paved surface must, therefore, be either replaced or buried under a new paved surface.

In order to prevent a paved surface from becoming damaged, maintenance must be periodically performed on the paved surface. One of the most common and useful maintenance procedures is crack repair. During crack repair, the cracks in a paved surface are sealed. In this manner, water, dirt and seeds are prevented from entering the crack and degrading the paved surface. Small cracks can be sealed simply by covering the crack with tar or liquefied asphalt. However, larger cracks are often filled with dirt, leaves, gravel and other debris. These larger cracks must be cleaned of this debris before they can be properly sealed.

Each contractor has a preferred method of cleaning out large cracks in paved surfaces. For instance, some contractors rely upon manual labor and have men armed with pneumatic chisels manually clean large cracks. This technique produces good results, but is very time consuming and labor intensive. In attempts to make crack cleaning more efficient, motorized saws are sometimes employed. In the prior art, there are many portable motorized saws that are used to cut groves into a paved surface or asphalt or concrete. These saws typically have a round rotating blade that can be lowered into the paved surface as the saw is moved along the paved surface. Such motorized saws are designed to cut straight lines in pavement and are usually used to make stress relief joints and other long, straight cuts.

When such a motorized saw is used to clean a pavement crack, many problems occur. One big problem is that cracks rarely run straight. A saw must therefore constantly be turned in direction as it follows a crack. With many prior art saws, the saw blade must be lifted out of the pavement, the saw turned to a new direction, and the saw blade replunged into the pavement each time the motorized saw changes direction. If the saw is turned with the blade in the pavement, the saw blade can bind and/or break.

Another problem associated with pavement cracks is that pavement cracks vary in width and depth from point to point along the length of the crack. If a prior art motorized saw is used, the saw blade must be constantly adjusted in cut depth to avoid excessive wear. Furthermore, a blade thicker than the widest part of the crack must be used to ensure the blade fully cleans the crack. This causes the blade to cut far more material than is required in most parts of the crack. This results in excessive wear to the blade and greatly decreases the life of the blade.

A need therefore exists for a pavement cutting machine that is specifically designed to follow and clean pavement cracks, wherein the cutting machine avoids the disadvantages of prior art cutting machines that have been previously mentioned.

SUMMARY OF THE INVENTION

The present invention is a cutting machine for cutting material from along a crack that is present in a paved surface. The cutting machine has a circular cutting blade that cuts into the paved surface. The cutting blade has an axis of rotation and a mid-axis that is perpendicular to the axis of rotation.

A wheeled platform is provided that has a plurality of wheels. The plurality of wheels are configured and oriented to cause the wheeled platform to turn about a predetermined point when the wheeled platform experiences a change in direction.

A mounting arbor is supported under the wheeled platform. The mounting arbor holds the circular cutting blade in an orientation where its axis of rotation extends in the horizontal and its mid-axis extends in the vertical. The mounting arbor retains the circular cutting blade in a position where its mid-axis generally aligns with the predetermined point around which the wheeled platform turns. In this manner, the mid-axis of the cutting blade remains in a fixed position when the wheeled platform is turned in a new direction. This allows the cutting blade to remain within the paved surface as the cutting blade is repeatedly reoriented to follow the meanderings of a pavement crack.

A motor is provided that is supported by the wheeled platform. The motor rotates the mounting arbor and the circular cutting blade. Furthermore, a handle is provided that is used to manually reorient the wheeled platform and align the cutting blade with the pavement crack.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention cutting machine can be used to clean existing grooves, such as stress relief grooves and water drainage grooves, in a paved surface, the present invention cutting machine is especially well suited for cleaning random cracks that inadvertently form. Accordingly, the exemplary embodiment of the present invention will describe the present invention cutting machine being used to clean a crack in a paved surface in order to set forth the best mode contemplated for the invention. However, the exemplified use of the cutting machine should not be considered a limitation on the potential use of the claimed cutting machine.

Figure 1:
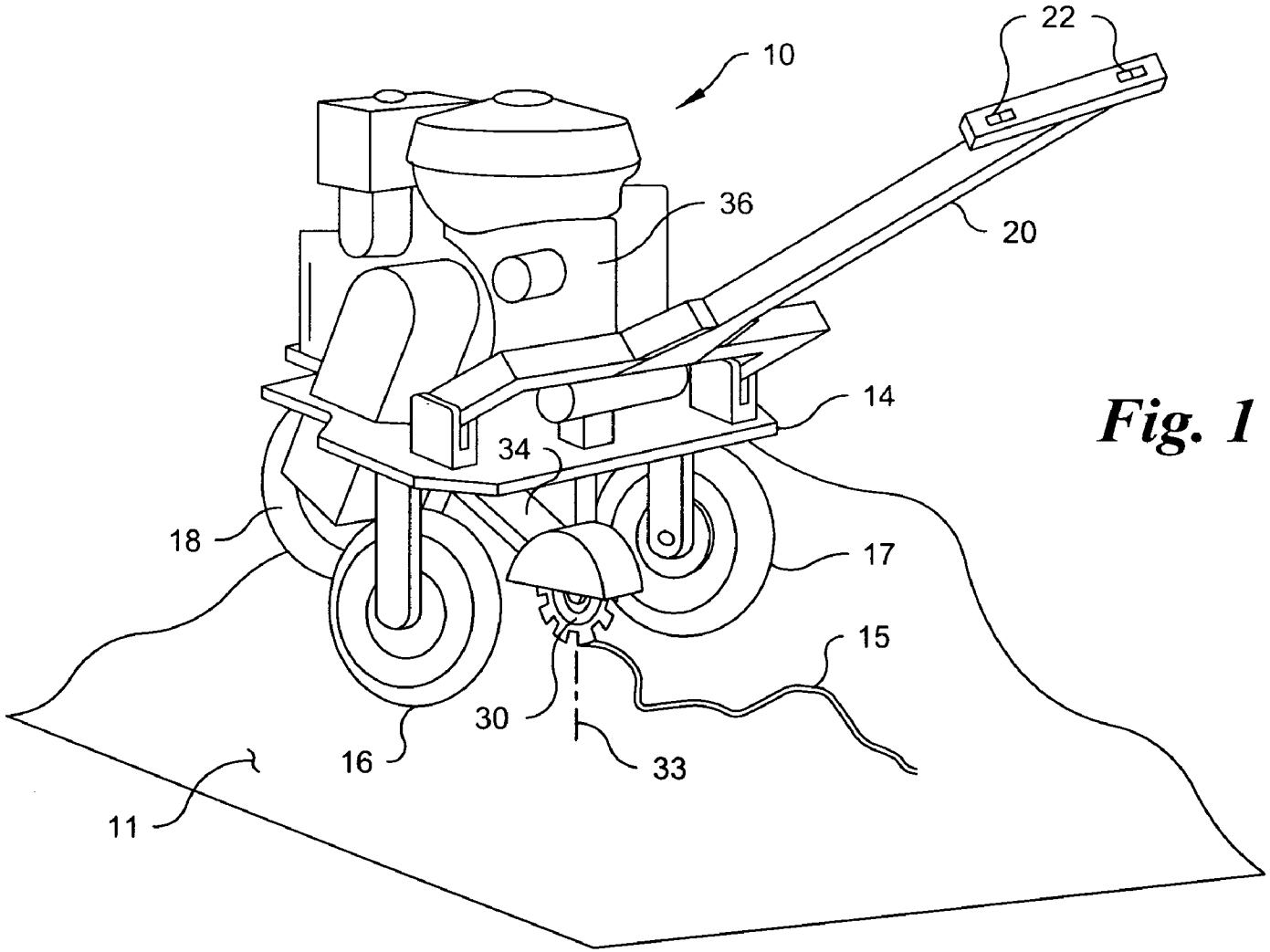
FIG. 1 is a perspective view of an exemplary embodiment of the present invention cutting machine shown cutting a crack on a paved surface.

Referring to FIG. 1, there is shown an exemplary embodiment of the present invention cutting machine 10. The cutting machine 10 is shown resting upon a paved surface 11, which contains surface cracks 15. The surface cracks 15 propagate through the paved surface in random directions. The surface cracks 15 also vary in width and depth from point to point.

The cutting machine 10 has a platform frame 14. The platform frame 14 is supported above the paved surface 11 by a plurality of large support wheels. The large support wheels include a set of fixed rear support wheels 16, 17 and a single free-moving front wheel 18. All the support wheels 16, 17 18 are wide so as not to fall into any of the cracks 15 present on the paved surface 11.

A handle 20 extends upwardly from the platform frame 14 of the cutting machine 10. Thus, the cutting machine 10 can be rolled along the paved surface 11 by pushing and pulling the handle 20. Controls 22 are present on the handle 20 for activating and deactivating the cutting machine 10, as will later be more fully described.

The fixed rear wheels 16, 17 are coaxially aligned below the platform frame 14. Consequently, the fixed rear wheels 16, 17 rotate in parallel planes. The front wheel 18 is equidistantly spaced both between, and forward of, the rear wheels 16, 17. This produces a stable tricycle configuration.

A cutting blade 30 is held under the platform frame 14. It is the cutting blade 30 that cuts into and cleans the crack 15. The cutting blade 30 is held in a vertical plane. The cutting blade 30 has a mid-axis 33 that passes vertically through the center of the cutting blade 30 in the same vertical plane as the cutting blade 30. The mid-axis 33 of the cutting blade 30 is an important reference point, as will later be explained.

The cutting blade 30 is attached to a pivot arm 34 under the platform frame 14. The pivot arm 34 holds the cutting blade 30 at a point equidistant from both fixed rear wheels 16, 17. The pivot arm 34 also holds the cutting blade 30 in a plane parallel to the fixed rear wheels 16, 17 so that the cutting blade 30 and the fixed rear wheels 16, 17 are generally aligned. The pivot arm 34 can be used to selectively raise and lower the cutting blade 30, as will be described later in greater detail. The controls 22 used to facilitate the raising and lowering of the cutting blade 30 are preferably present on the handle 20.

A primary motor 36 is present on the top of the platform frame 14. The primary motor 36 can be an electric motor. However, in the shown embodiment a gasoline powered motor is shown. The primary motor 36 powers the rotation of the cutting blade 30.

Figure 2:
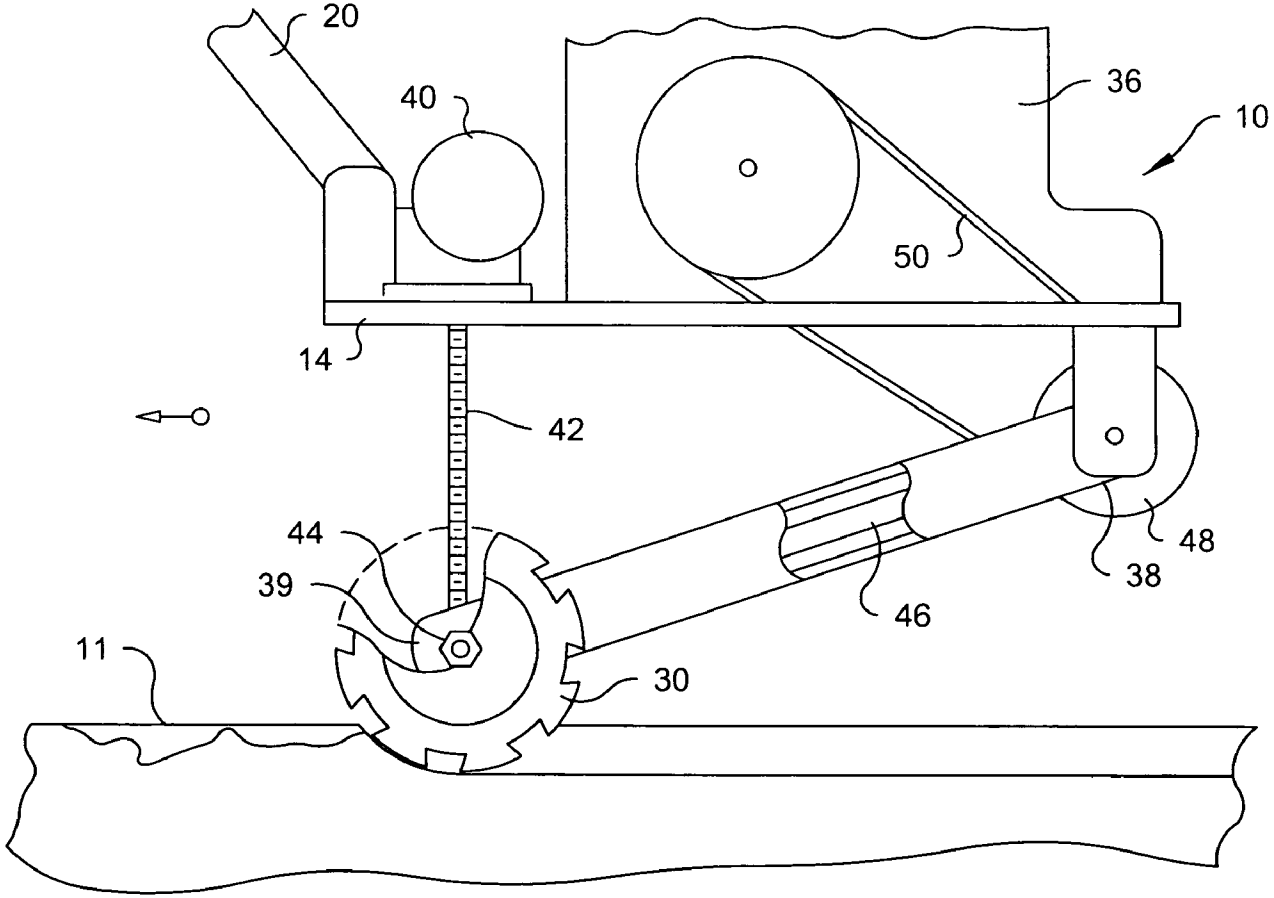
FIG. 2 is a selectively cross-sectioned side view of the embodiment of the cutting machine shown in FIG. 1.

Referring to FIG. 2, it can be seen that the pivot arm 34 under the platform frame 14, has two ends. The rearward end 38 of the pivot arm is pivotably connected to the platform frame 14. Consequently, the forward end 39 of the pivot arm 34 is free to rotate both up and down about the pivot connection.

A secondary motor 40 is also present on the platform frame 14, next to the primary motor 36. The secondary motor 40 selectively raises and lowers an activator arm 42. The activator arm 42 attaches to the pivot arm 34 near the forward end 39 of the pivot arm 34. Accordingly, when the secondary motor 40 is activated, the pivot arm 34 will either rotate upwardly or downwardly, depending upon the directional movement of the activator arm 42. The controls for the secondary motor 40 are preferably present on the handle 20 of the cutting machine 10. Accordingly, a person holding the handle 20 can operate the secondary motor 40 and selectively raise or lower the pivot arm 34.

The cutting blade 30 is supported by the forward end 39 of the pivot arm 34. Accordingly, as the pivot arm 34 rotates upwardly or downwardly, the cutting blade 30 is either raised or lowered. At its highest point, the pivot arm 34 can be raised to completely raise the cutting blade 30 above the paved surface 11. At its lowest point, the pivot arm 34 can be lowered to set the cutting blade 30 into the paved surface 11 up to its hub.

The cutting blade 30 is connected to a mounting arbor 44. The mounting arbor 44 is rotated by a compound drive shaft 46. The compound drive shaft 46 includes geared joints to enable the mounting arbor 44 to be positioned perpendicular to the primary length of the compound draft shaft 46. The compound drive shaft 46 is connected to a flywheel 48. The flywheel 48 is turned by a fan belt 50, which is turned by the primary motor 36. It will therefore be understood that the cutting blade 30 can be turned by the primary motor 36 regardless of the height of the cutting blade 30 relative to the paved surface 11. The cutting blade 30 is, therefore, fully powered throughout its range of motion.

The speed of rotation for the cutting blade 30 is dependent upon the speed of rotation for the primary motor 36. Throttle controls for the primary motor 36 are preferably located on the handle 20 of the cutting machine 10 for easy operation.

Figure 3:
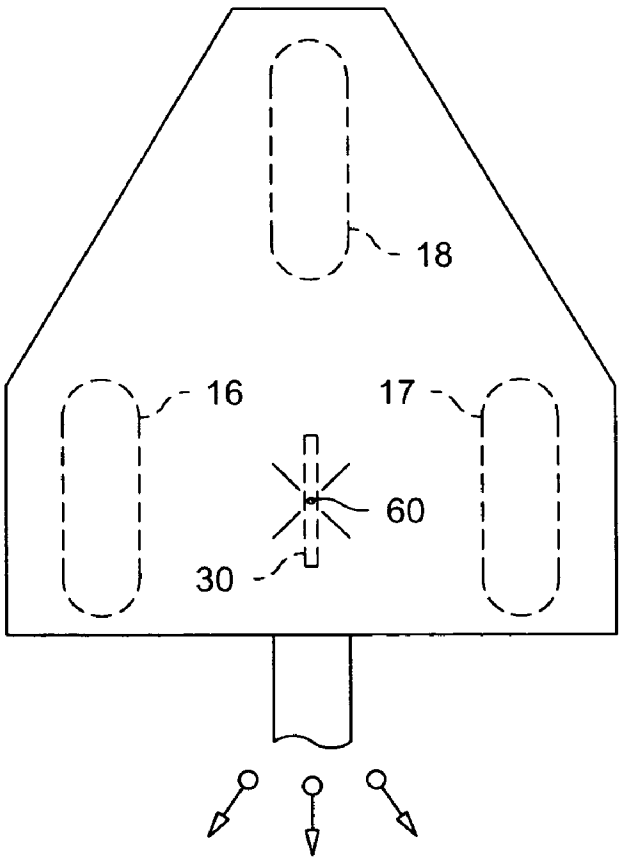
FIG. 3 is a schematic illustrating the relationship between the wheels, cutting blade and center of turning for the cutting machine.

Referring to FIG. 3 in conjunction with FIG. 1, it can be seen that the cutting blade 30 is centrally located in between the two fixed rear wheels 16, 17. The two fixed rear wheels 16, 17 and the cutting blade 30 all rotate in parallel planes. Furthermore, the axes of rotation for the two fixed rear wheels 16, 17 and the cutting blade 30 are coaxially aligned or nearly coaxially aligned depending upon the height at which the cutting blade 30 is held. The front wheel 18 is aligned in the same plane as is the cutting blade 30. The front wheel 18 has a caster mount and therefore can roll upon the paved surface 11 in any direction. The fixed rear wheels 16, 17 are set in direction and can only roll in a single plane that is parallel to the plane of the cutting blade 30.

With the cutting blade 30 so positioned in relation to the fixed rear wheels 16, 17 and the front wheel 18, when the handle 20 is pushed or pulled, the platform frame 14 tends to turn about a predetermined turn center axis 60. The turn center axis 60 is positioned in between the fixed rear wheels. Furthermore, the turn center axis 60 (FIG. 3) is vertically aligned with the vertical mid-axis 33 (FIG. 1) of the cutting blade 30. Accordingly, the cutting machine 10 can be turned in any direction while the mid-axis 33 of the cutting blade 30 remains in a set position.

It will therefore be understood that as the cutting machine 10 is pulled along a crack 15, the cutting machine 10 can be turned while the mid-axis 33 of the cutting blade 30 remains at a single point along the crack 15. The cutting blade 30 therefore does not have to be advanced along the crack 15 in order to be turned. Rather, the orientation of the cutting blade 30 relative to the crack can be changed by turning the cutting machine 10, while the cutting blade 30 remains at the same point along the crack. As a result, the cutting blade 30 can be caused to continuously follow a wandering crack 15, in full engagement with the paved surface 11, without having the cutting blade 30 experience any unnecessary stresses that can damage the cutting blade 30. Furthermore, the cutting blade 30 can be made to follow the convoluted path of a crack 15 without having to raise the cutting blade 30 each time the direction of the cutting blade's travel is to be changed.

Returning solely to FIG. 1, the operation of the cutting machine 10 will now be understood. The cutting blade 30 is raised to a level above the paved surface 11 and the cutting machine 10 is wheeled to the beginning of a crack 15. The cutting blade 30 is then oriented with the crack 15 by rotating the cutting machine 10 above the crack 15. Once the cutting blade 30 is oriented with the beginning of the crack 15, the cutting blade 30 is rotated and the cutting blade 30 is lowered into the crack 15. The start of rotation for the cutting blade 30 and its being lowered into the crack 15 can be performed using the controls on the handle 20 of the cutting machine 10.

By pulling and turning the handle 20, the cutting blade 30 is caused to follow the meandering pattern of the crack 15 in the paved surface 11. If the crack 15 ever becomes wider, narrower, deeper or shallower, the height of the cutting blade 30 can be selectively adjusted to meet the need. As the cutting blade 30 spins, the cutting blade 30 cleans all loose debris from the crack 15 and widens the crack 15 to a generally standard size. The crack 15 can then be readily filled with a patch material, thus repairing the crack 15.

It will be understood that a person skilled in the art can make many variations of the exemplary embodiment of the cutting machine that has been described. For instance, there are many different ways that a motor can be connected to the cutting blade so as to turn the cutting blade. Furthermore, there are many ways that the cutting blade can be caused to selectively raise and lower. What is of importance is that the cutting blade is positioned in the center of the rear wheels so that the entire cutting machine can be turned and reoriented without either advancing or retreating the point where the cutting blade contacts the crack. In this manner, the cutting blade can be left in contact with the crack as the cutting blade is constantly reoriented to follow the convoluted path of the crack. All such variations, alternate embodiments and modifications are intended to be included within the scope of the present invention as defined by the claims.

What is claimed is:

1. A cutting machine for cutting into cracks that are present in a paved surface, said cutting machine comprising:

a wheeled platform having two fixed wheels that are coaxially aligned in a fixed orientation a predetermined distance apart, and a third wheel that is offset from said fixed wheels and has an orientation dependent upon a direction of travel associated with said wheeled platform;

a motor supported by said wheeled platform;

a cutting blade rotated by said motor, wherein said cutting blade is disposed in between said two fixed wheels at a position generally equidistant from said two fixed wheels, and wherein said cutting blade rotates in a plane that intersects said third wheel; and a handle for manually guiding said wheeled platform on the paved surface along a path of a crack.

2. The machine according to claim 1, wherein said two wheels have fixed orientations and rotate in parallel planes.

3. The machine according to claim 2, wherein said cutting blade rotates in a plane parallel to said two wheels.

4. The machine according to claim 1, further including a mechanism for selectively raising and lowering said cutting blade throughout a range of motion.

5. The machine according to claim 4, wherein said mechanism for selectively raising and lowering said cutting blade has operational controls present on said handle.

6. The machine according to claim 4, wherein said mechanism for raising and lowering said cutting blade includes an arm that is connected with a pivot connection to said wheeled platform, wherein said cutting blade is supported by said arm and is raised and lowered as said arm rotates about said pivot connection.

7. A cutting machine, comprising:

a circular cutting blade having an axis of rotation and a mid-axis that is perpendicular to said axis of rotation;

a wheeled platform having a plurality of wheels, wherein said plurality of wheels cause said wheeled platform to turn about a predetermined point when said wheeled platform experiences a change in direction;

a pivot arm containing an internal drive shaft, said pivot arm having a first end that is pivotally connected to said wheeled platform;

a mounting arbor that is rotated by said drive shaft at said second end of said pivot arm, wherein said mounting arbor holds said circular cutting blade in an orientation where said axis of rotation extends in the horizontal and said mid-axis extends in the vertical;

wherein said mounting arbor retains said circular cutting blade in a position where said mid-axis of said cutting blade generally aligns with said predetermined point on said wheeled platform;

a motor supported by said wheeled platform;

a flywheel supported at a fixed location by said wheeled platform, said flywheel being mechanically interconnected with said drive shaft in said pivot arm, wherein said drive shaft rotates when said flywheel rotates;

a fan belt connecting said flywheel to said motor; and a handle for manually turning said wheeled platform.

8. The machine according to claim 7, wherein said plurality of wheels includes two fixed wheels that rotate in parallel planes.

9. The machine according to claim 8, wherein said mounting arbor holds said circular cutting blade in between said two fixed wheels, and in a plane parallel to said two fixed wheels.

10. The machine according to claim 7, further including a mechanism for selectively raising and lowering said circular cutting blade throughout a range of motion by rotating said drive shaft around said first end.

11. The machine according to claim 10, wherein said mechanism for selectively raising and lowering said circular cutting blade has operational controls present on said handle.

12. The machine according to claim 8, wherein said wheeled platform includes at least one other wheel that is not coaxially aligned with said two fixed wheels and is not fixed in any one plane of rotation.

* * * * *